US008109504B2

(12) United States Patent
Matsuoka

(10) Patent No.: US 8,109,504 B2
(45) Date of Patent: Feb. 7, 2012

(54) PAPER FEEDING CASSETTE

(75) Inventor: Keiji Matsuoka, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 345 days.

(21) Appl. No.: 12/219,357

(22) Filed: Jul. 21, 2008

(65) Prior Publication Data

US 2009/0026694 A1 Jan. 29, 2009

(30) Foreign Application Priority Data

Jul. 25, 2007 (JP) ..... 2007-193366

(51) Int. Cl.
*B65H 1/00* (2006.01)

(52) U.S. Cl. ..... 271/171; 271/223

(58) Field of Classification Search ..... 271/171, 271/223; 411/351, 923
See application file for complete search history.

(56) References Cited

U.S. PATENT DOCUMENTS 2,257,174 A * 9/1941 Langley ..... 271/2
3,034,611 A * 5/1962 Zenzic ..... 403/408.1
3,512,446 A * 5/1970 Sekhon ..... 411/399
5,238,238 A * 8/1993 Shinohara et al. ..... 271/145
6,116,591 A * 9/2000 Kim ..... 271/171
6,118,959 A * 9/2000 Michlin ..... 399/109
2003/0006284 A1 * 1/2003 Kohchi et al. ..... 235/454

FOREIGN PATENT DOCUMENTS

JP 7-40646 7/1995
JP 2005-231862 9/2005

* cited by examiner

*Primary Examiner* — Kaitlin Joerger
*Assistant Examiner* — Ernesto Suarez
(74) *Attorney, Agent, or Firm* — Smith, Gambrell & Russell, LLP

(57) ABSTRACT

The paper feeding cassette 10 has the cassette frame 10 for loading and storing paper, and the width-wise cursor 20 which is disposed in the cassette frame 10 and movably carries out the positioning of paper in the paper-width direction intersecting at right angles with the paper feeding direction, and can be pulled out from a machine main body. Provided are the plurality of engagement holes 14 formed in the cassette frame 10 corresponding to a paper width, the through-holes 23 formed through the width-wise cursor 20, and the lock pins 40 which engage with the engagement holes 14 via the through-holes 23 to prevent the width-wise cursor 20 from deviating in the paper-width direction.

11 Claims, 11 Drawing Sheets

PAPER FEEDING CASSETTE

This application is based on Japanese Patent Application No. 2007-193366 filed on Jul. 25, 2007, the contents of which are hereby incorporated by reference.

BACKGROUND OF THE INVENTION

1. Field of the Invention

The present invention relates to a paper feeding cassette used to stock many sheets of paper which are fed to a machine.

2. Description of Related Art

A paper feeding cassette is used in an image forming apparatus, typically, a copying machine or a printer to feed paper such as a cut sheet and the like. There are many paper feeding apparatuses for image forming apparatuses that stock many sheets of paper before printing in advance and separately feed one sheet of paper after another from the topmost of the sheets piled up in a paper feeding cassette.

Some paper feeding cassettes are provided with a cursor. A cursor is movable along a rail disposed in a paper feeding cassette and contacts the sides of paper piled up in the paper feeding cassette to position the paper. Thus, the paper does not move from a given position and it becomes possible to carry out a stable paper feeding.

There are two types of cursor: one is a length-wise cursor that positions paper in the paper feeding direction and the other is a width-wise cursor that positions paper in the paper-width direction perpendicular to the paper feeding direction. These cursors are provided with lock means to lock the cursors in position that correspond to a paper size. Widely used is lock means that is comprised of a sawtooth rack and a engagement claw that engages with the rack.

However, if paper is loaded in a paper feeding cassette and a user tries to roughly move the paper feeding cassette in the paper-width direction, the bundle of paper is deviated relatively with respect to the paper feeding cassette under inertia and exceeds the limitation force of the cursor, and thus the lock piece is dislocated and the lock can be released. Accordingly, the paper moves in the paper-width direction together with the cursor. Consequently, it causes problems that the suitable paper feeding becomes impossible, and deviation of printed images or paper jam occurs.

To solve such problems, approaches have been proposed to prevent the unexpected movement of a lock piece that locks a width-wise cursor in position, and an example of such a paper feeding cassette is disclosed in JP-A-2005-231862.

In JP-A-2005-231862, a width-wise cursor that carries out the positioning of paper in the paper-width direction is disposed inside a cassette frame, under the width-wise cursor, a lock piece is rotatably supported in a plane intersecting at right angles with the paper-width direction, and the lock piece is energized in the lock direction by energizing means that is disposed near the pivotal shaft. An engagement hole is provided in the bottom surface of the width-wise cursor, a lock pin is provided on the upper surface of the lock piece, and the lock pin is inserted into the engagement hole to lock the width-wise cursor to prevent it from deviating in the paper-width direction. When a release rod disposed in the width-wise cursor is pushed down, the lock piece is moved to a lock release position, which is the technology disclosed in JP-A-2005-231862. With this technology, it is possible to prevent paper form deviating in the paper-width direction even if a user moves roughly the paper feeding cassette in the paper-width direction.

However, in the conventional technology described above, there are many constituting members such as a lock piece to hold a lock pin, energizing means, a release rod to release lock, etc. Besides, there has been a disadvantage that it takes a long time to assemble these constituting members with a paper feeding cassette.

In JP-U-1995-40646, provided is lock means that fixes the position of a width-wise cursor when a lid covers the upper surface of a cassette frame, and releases the width-wise cursor from the fixed position when the lid opens the upper surface of the cassette frame. However, because the lock means comprises a chevron-shaped protrusion in section and a recessed portion formed in the lid to engage with the protrusion, and because the lock means has a low reliability in its engagement, there has been a problem that the lock means comes out of the engagement if paper is loaded roughly.

SUMMARY OF THE INVENTION

The present invention has been made to cope with the problems described above, and it is an object of the present invention to provide a paper feeding cassette that prevents the positional deviation of a cursor even when the paper feeding cassette is moved roughly, and surely fixes the cursor for various paper sizes with a simple structure.

To achieve the above objects, a paper feeding cassette according to one aspect of the present invention has a cassette frame for storing loaded paper, and a cursor which is disposed in the cassette frame to movably carry out the positioning of paper, and which can be pulled out form a machine main body, the apparatus comprises: a plurality of engagement holes which are formed in the cassette frame and correspond to paper sizes; through-holes formed through the cursor; lock pins that engage with the engagement holes via the through-holes to prevent the cursor from deviating.

According to this structure, because the cursor is locked not to deviate in the moving direction when the lock pin is inserted thorough the through-hole to engage with the engagement hole, it is possible to prevent the positional deviation of the cursor even when the paper feeding cassette is roughly moved in the moving direction, and to surely fix the cursor for various paper sizes with the simple structure composed of the lock pins, the through-holes through the cursor, and the engagement holes formed in the cassette frame.

Besides, the present invention is characterized in that in the paper feeding cassette having the structure described above, the through-hole is provided with a conic hole, and the lock pin is provided with an engagement portion and a conic portion formed on the upper portion of the engagement portion, wherein the engagement portion engages with the engagement hole, and the conic portion fits into the conic hole.

According to this structure, when the engagement portion engages with the engagement hole and the conic portion fits into the conic hole, the cursor is surely positioned and fixed to the cassette frame.

Further, the present invention is characterized in that in the paper feeding cassette having the structure described above, the conic portion of the lock pin is provided with a cutout portion, and a gap is formed between the conic hole and the cutout portion when the engagement portion engages with the engagement hole and the conic portion fits into the conic hole.

According to this structure, because the gap is formed between the conic hole and the cutout portion, when a user inserts a finger into the gap and pulls the lock pin from the conic hole, the lock pin is pulled out and the paper size can be easily changed.

The present invention is characterized in that in the paper feeding cassette having the structure described above, the lock pin is provided with a substantially U-shaped hook along the cutout portion, and the hook is movable in the direction along the cutout portion and in the axis direction of the lock pin.

According to this structure, because the hook is movably disposed on the conic portion of the lock pin, a user can grip the hook with a finger and easily pull out the lock pin from the through-hole.

The present invention is characterized in that in the paper feeding cassette having the structure described above, the cursor has a horizontal portion on which paper is loaded, and a paper collision portion perpendicular to the horizontal portion, and the horizontal portion is disposed on the cassette frame, wherein the conic hole is formed in the horizontal portion, and the conic portion does not protrude outside the horizontal portion once it fits into the conic hole.

According to this structure, because the conic portion does not protrude outside the horizontal portion, the paper loaded on the horizontal portion is not damaged.

The present invention is characterized in that in the paper feeding cassette having the structure described above, the lock pin is fixed to a plate member.

According to this structure, because the cursor is locked so that it cannot deviate in the moving direction when the lock pin is inserted through the through-hole and engages with the engagement hole, it is possible to prevent the positional deviation of the cursor even when the paper feeding cassette is roughly moved in the moving direction, and to surely fix the cursor for various paper sizes with the simple structure. Besides, because the lock pin is fixed to and supported by the plate member, the lock pin can be easily inserted and pulled out.

The present invention is characterized in that in the paper feeding cassette having the structure described above, the cursor has a horizontal portion on which paper is loaded, and a paper collision portion perpendicular to the horizontal portion, and the horizontal portion is disposed on the cassette frame, wherein when the conic portion fits into the conic hole, the plate member is accommodated in a recessed portion formed in the horizontal portion and does not protrude outside the horizontal portion.

According to this structure, because the plate member does not protrude outside the horizontal portion, the paper loaded on the horizontal portion is not damaged.

The present invention is characterized in that in the paper feeding cassette having the structure described above, near the place where the lock pin of the plate member is fixed, a gap is formed between an edge portion of the plate member and the recessed portion when the engagement portion engages with the engagement hole.

According to this structure, because the gap is formed between an edge portion of the plate member and the recessed portion, when a user inserts a finger into the gap and pulls the plate member from the recessed portion, the lock pin is pulled out from the engagement hole and the paper size can be easily changed.

The present invention is characterized in that in the paper feeding cassette having the structure described above, the cassette frame is provided with lines of a plurality of engagement holes corresponding to a plurality of paper-size systems, and the cursor is provided with through-holes corresponding to the respective lines of engagement holes.

According to this structure, paper of a plurality of paper-size systems, for example, the metric system, the inch system and the like can be stored in the paper feeding cassette, and the paper position of a desired paper size can be easily recognized. Besides, it is possible for one paper feeding cassette to be compatible with many kinds of paper size systems without increasing the kinds of paper feeding cassettes.

The present invention is characterized in that in the paper feeding cassette having the structure described above, the engagement holes in the respective lines are provided in pairs in the direction perpendicular to the cursor moving direction, the respective lines being parallel with each other and being at positions apart from each other.

According to this structure, even if the kinds of paper sizes in the respective paper-size systems increase, it is easy to recognize the paper position of a desired paper size and it is also possible to prevent the overlap between the plurality of engagement holes. Thus, it is possible for one paper feeding cassette to be compatible with many kinds of paper sizes without increasing the kinds of paper feeding cassettes.

The present invention is characterized in that in the paper feeding cassette having the structure described above, the distances between the paired engagement holes in the respective lines are different from each other depending on the respective lines of engagement holes, and a pair of the lock pins are disposed in the plate member for each line of engagement holes, and the distances between the respective pairs of the lock pins are different from each other.

According to this structure, because a pair of lock pins are disposed in the plate member, it is easy to recognize the paper position of a desired paper size even if the kinds of paper size increase, and the lock pins can be easily inserted and pulled out from the engagement holes. Besides, it is possible for one paper feeding cassette to be compatible with many kinds of paper sizes without increasing the kinds of paper feeding cassettes.

The present invention is characterized in that in the paper feeding cassette having the structure described above, the paired engagement holes in the respective lines of engagement holes are disposed with the same distance therebetween for the respective lines of engagement holes, the lock pins are disposed in pairs in the plate member for the respective pairs of engagement holes, and the distances between the paired lock pins are the same.

According to this structure, because a pair of lock pins are disposed in the plate member, it is easy to recognize the paper position of a desired paper size even if the kinds of paper size increase, and the lock pins can be easily inserted and pulled out from the engagement holes. Besides, it is possible for one plate member to be compatible with many kinds of paper size systems, and the structure of the apparatus becomes simple. Further, it is also possible for one paper feeding cassette to be compatible with many kinds of paper size without increasing the kinds of paper feeding cassette.

DETAILED DESCRIPTION OF PREFERRED EMBODIMENTS

Figure 1:
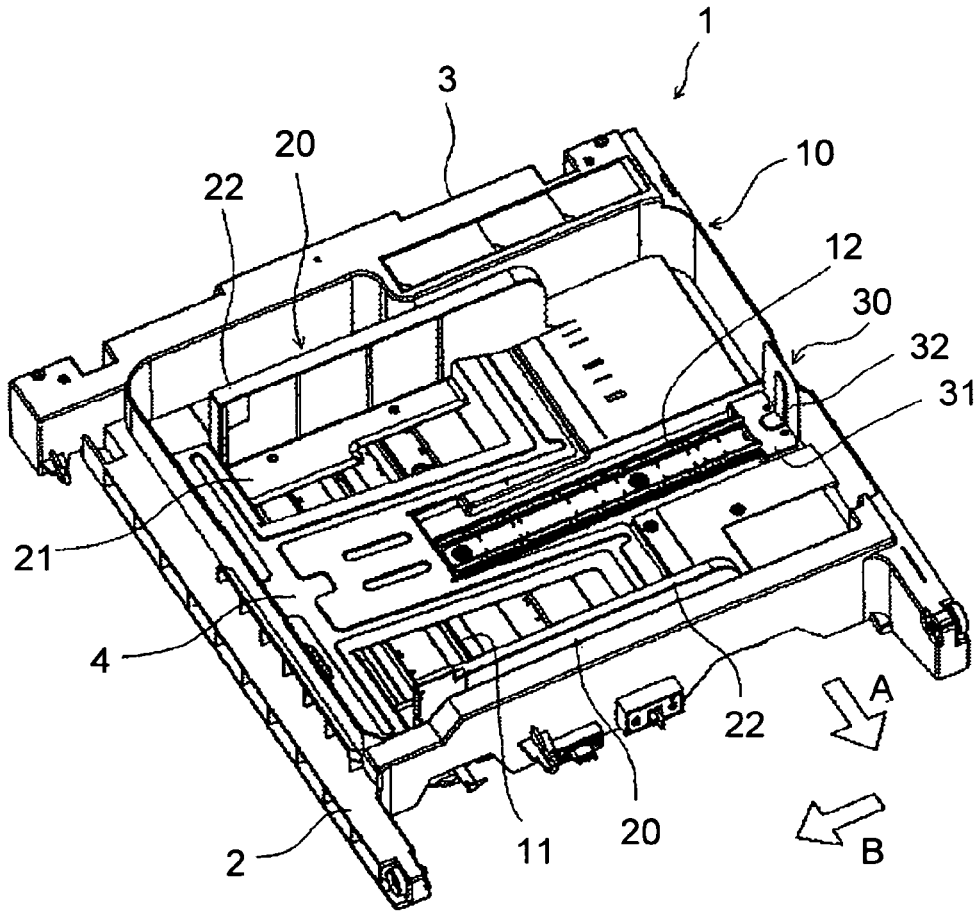
FIG. 1 is a perspective view seen from diagonally above the rear side of a paper feeding cassette according to an embodiment of the present invention.

Infra, the embodiments of the present invention are described referring to the drawings, but the present invention is not limited to the embodiments. The embodiments of the present invention are described as the most preferred embodiments, and the uses of the present invention and the terms are not limited to those used herein.

First, a schematic structure of a paper feeding cassette according to the present invention is described using FIG. 1. FIG. 1 is a perspective view seen from diagonally above the rear side of a paper feeding cassette according to an embodiment of the present invention. On the front side of the paper feeding cassette, disposed is a panel which a user grips with a finger to pull out the paper feeding cassette, and the rear side is the surface opposite to the panel.

In FIG. 1, a paper feeding cassette 1 is housed in the lower portion of an image forming apparatus, not shown, such as a copying machine or the like. The paper feeding cassette 1 is slid in the arrow A direction shown if FIG. 1 and inserted into an image forming apparatus with horizontal protruding portions 2 disposed on the sides of the paper feeding cassette 1 engaged with rails inside the image forming apparatus. The main body portion of the paper feeding cassette 1 comprises a cassette frame 10. The cassette frame 10 comprises a flat box whose upper surface is opened, and paper is loaded and stored from the upper surface direction. In an image forming apparatus, paper feeding means, not shown, is disposed over the paper feeding cassette 1, and the paper is fed in the B direction shown in FIG. 1. A panel 3 is disposed on the front side of the cassette frame 10, and this panel 3 constitutes a part of the housing at the front lower portion of an image forming apparatus. When pulling out the paper feeding cassette 1, a user grips the lower portion of the panel 3 with a finger.

A lift plate 4 is disposed on the inner bottom surface of the cassette frame 10. Paper is loaded on this lift plate 4. The upstream end of the lift plate 4 in the paper feeding direction is supported on the inner bottom surface of the cassette frame 10, and the lift plate 4 is rotatable about the fulcrum with the downstream end as the free end. The lift plate 4 is a plate-shaped member, and cutouts are formed in the movable regions of a width-wise cursor 20 and a length-wise 30 which are described later.

A width-wise cursor 20 is disposed in the downstream portion in the paper feeding direction inside the cassette frame 10. Two width-wise cursors 20 are arranged, and contact the sides of a bundle of paper from both sides in the paper-width direction intersecting at right angles with the paper feeding direction (the arrow B). The width-wise cursor 20 has an L shape in the vertical section seen from the paper feeding direction, and comprises a horizontal portion 21 and an upright paper collision portion 22. The two width-wise cursors 20 are disposed with the paper collision portions 22 facing each other, and paper is loaded on each of the horizontal portions 21 and between the paper collision portions 22. The width-wise cursors 20 conduct the positioning of paper in the paper-width direction in order for the paper to be positioned at a paper feeding position of the paper feeding means of an image forming apparatus.

The width-wise cursors 20 can be moved along moving grooves 11 formed on the cassette frame 10 in the paper-width direction, while the horizontal portions 21 contacting the cassette frame 10. Because engagement portions, not shown, formed on the bottom surface of the width-wise cursors 20 are engaged with the moving grooves 11, the width-wise cursors 20 do not come off upward. The two width-wise cursors 20 which contact the sides of a bundle of paper from both sides in the paper-width direction are provided with an interlock mechanism thereunder. The interlock mechanism is composed of racks each being disposed on each of the two width-wise cursors 20, and a pinion mounted on the cassette frame 10. When one of the width-wise cursors 20 is moved by this interlock mechanism, the other also moves interlocking with the one. At this time, the two width-wise cursors 20 move symmetrically with respect to the center line of paper in the paper-width direction.

The length-wise cursor 30 is disposed at the upstream portion in the paper feeding direction inside the cassette frame 10. One length-wise cursor 30 is disposed and contacts the side of a bundle of paper from the upstream side in the paper feeding direction (the arrow B). The length-wise cursor 30 has an L shape in the vertical section seen from the cassette frame slide direction (the arrow A), and comprises a horizontal portion 31 and an upright paper collision portion 32. Paper is loaded on the horizontal portion 31 and in the downstream portion with respect to the paper collision portion 32. The length-wise cursor 30 conducts the positioning of paper in the paper feeding direction in order for the paper to be positioned at a paper feeding position of the paper feeding means of an image forming apparatus.

The length-wise cursor 30 can be moved along a moving rail 12 formed on the cassette frame 10 in the paper feeding direction. Because an engagement portion, not shown, formed on the bottom surface of the length-wise cursor 30 is engaged with the moving rail 12, the length-wise cursor 30 does not come off upward.

First Embodiment

Figure 2:
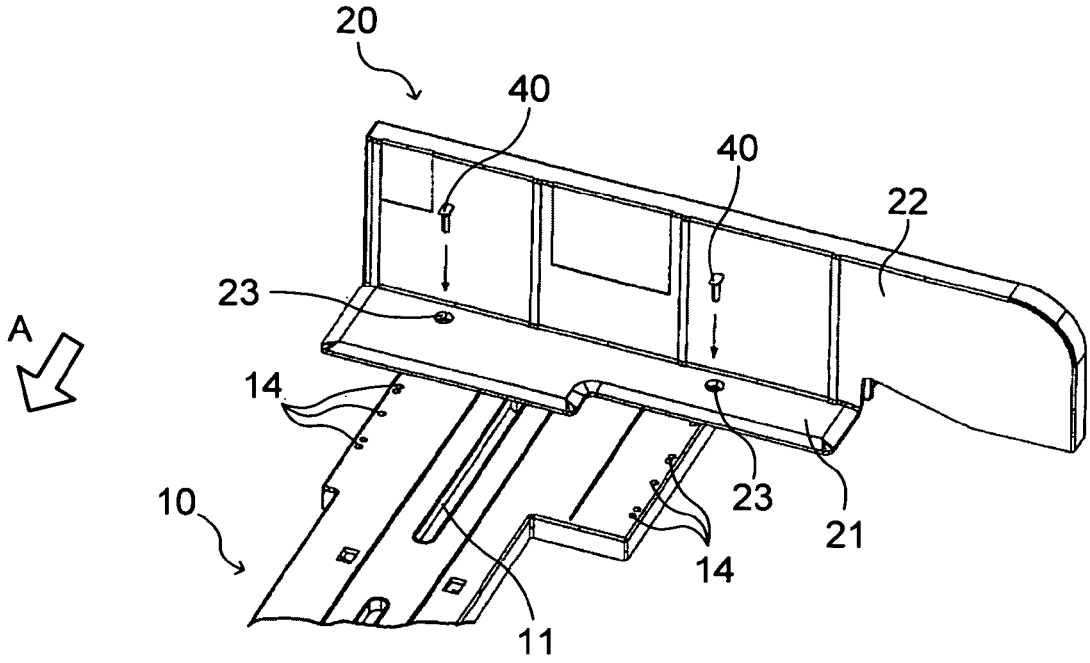
FIG. 2 is a perspective view showing a mounting portion of a width-wise cursor of a paper feeding cassette according to a first embodiment of the present invention.
Figure 3:
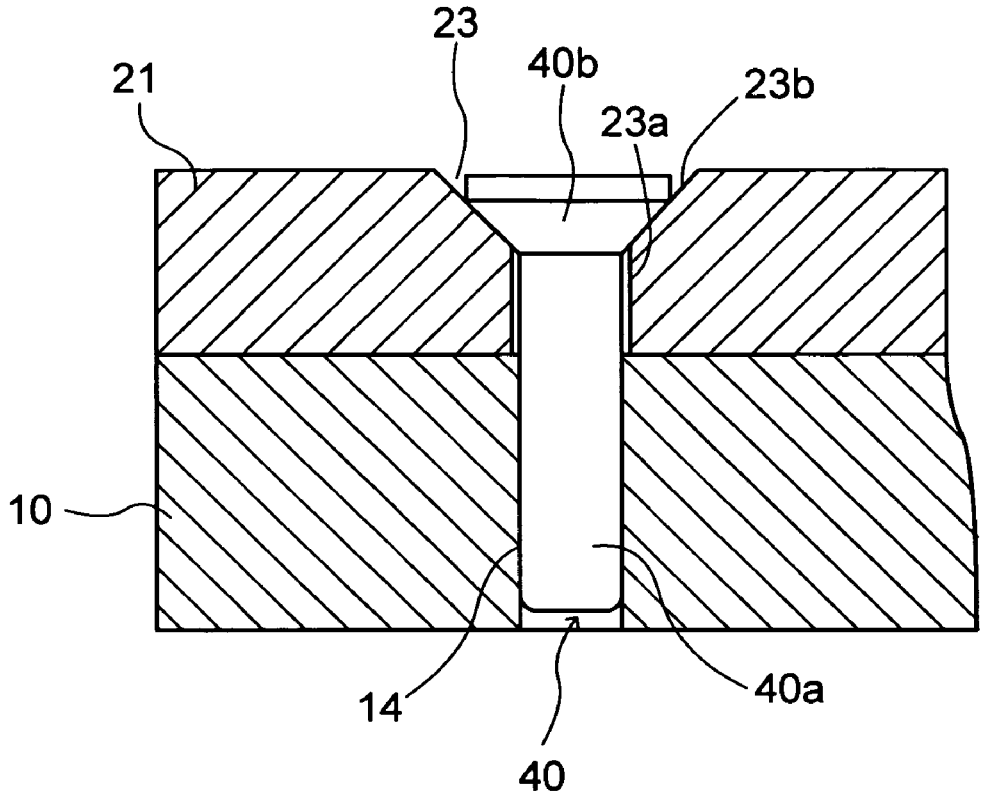
FIG. 3 is a sectional view showing a state where a lock pin is engaged with a cassette frame and a width-wise cursor of the paper feeding cassette according to the first embodiment of the present invention.
Figure 4:
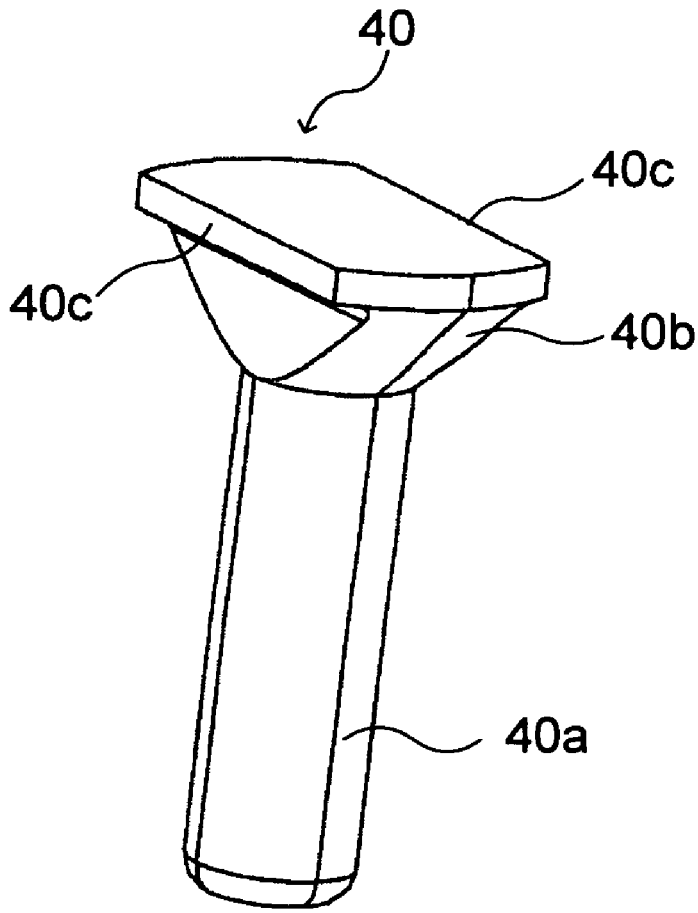
FIG. 4 is a perspective view showing a lock pin of the paper feeding cassette according to the present invention.

A first embodiment of the present invention is explained using FIGS. 2 to 4. FIG. 2 is a perspective view showing a mounting portion of a width-wise cursor of a paper feeding cassette. FIG. 3 is a sectional view showing a state where a lock pin is engaged with a cassette frame and a width-wise cursor of a paper feeding cassette. FIG. 4 is a perspective view showing a lock pin.

As shown in FIG. 2, the cassette frame 10 is provided with a plurality of engagement holes 14. A pair of the engagement holes 14 are provided corresponding to each of a plurality of paper width sizes in the direction (the arrow A shown in FIG. 2) in which the width-wise cursor 20 slides horizontally.

The width-wise cursor 20 is provided with two through-holes 23 through the horizontal portion 21. The through-holes 23 are arranged corresponding to the distance between the paired engagement holes 14. Each lock pin 40 can be inserted into each through-hole 23.

When the lock pin 40 is inserted into the through-hole 23, the width-wise cursor 20 is positioned and fixed to the cassette frame 10 as shown in FIG. 3. The lock pin 40 is provided with a cylindrical engagement portion 40*a* and a conic portion 40*b* on the cylindrical engagement portion 40*a*. The engagement portion 40*a* engages with the engagement hole 14 of the cassette frame 10, and the width-wise cursor 20 is fixed to the cassette frame 10. The conic portion 40*b* fits into the conic hole 23*b* of the through-holes 23. Because the centers of the conic portion 40*b* and the conic hole 23*b* are formed coaxially with the centers of the engagement portion 40*a* and the engagement hole 14, the width-wise cursor 20 is positioned in the cassette frame 10 when the conic portion 40*b* fits into the conic hole 23*b*. At this time, the conic portion 40*b* does not protrude outside the horizontal portion 21, and does not damage paper. To allow the assembly of the components such as the cassette frame 10, the width-wise cursor 20 and the like even if their machining precisions are low, the hole 23*a* of the through-hole 23 is made larger than the engagement portion 40*a* of the lock pin 40 so that the hole 23*a* does not engage with the engagement portion 40*a*.

Two pairs of engagement holes 14 are symmetrically arranged with respect to the center line in the width direction of the cassette frame 10, that is, one pair on one side of the cassette frame 10 and the other pair on the other side, and each pair corresponding to each pair of through-holes 23 disposed on the two width-wise cursors 20. In such structure comprising each through-hole 23, and the four lock pins 40 each of which engages with each engagement hole 14, when the lock pin 40 is inserted into the through-hole 23 and engaged with the engagement hole 14, the width-wise cursors 20 are locked not to deviate in the paper-width direction.

As shown in FIG. 4, the conic portion 40*b* of the lock pin 40 is provided with two cutout portions 40*c*. When the engagement portion 40*a* of the lock pin 40 engages with the engagement hole 14 and the conic portion 40*b* fits into the conic hole 23*b* (see FIG. 3), a gap is formed between the cutout portion 40*c* and the conic hole 23*b*. When pulling out the lock pin 40 from the conic hole 23*b* to move the width-wise cursor 20, a user can insert a finger into the gap and pull out the lock pin 40.

According to the first embodiment, the paper feeding cassette 1 comprises a cassette frame 10 in which paper is loaded and stored, and the width-wise cursors 20 which movably conduct the positioning of paper in the paper-width direction intersecting at right angles with the paper feeding direction, and can be pulled out from a machine main body. Also, the paper feeding cassette 1 comprises the plurality of engagement holes 14 formed in the cassette frame 10 corresponding to paper sizes, the through-holes 23 formed through the width-wise cursors 20, and the lock pins 40 which engage with the engagement holes 40 via the though-holes 23 not to allow the width-wise cursors 20 to deviate in the paper-width direction.

According to this structure, because the width-wise cursors 20 are locked not to deviate in the paper-width direction when the lock pins 40 are inserted into the through-holes 23 and are engaged with the engagement holes 14, it is possible to prevent the positional deviation of the width-wise cursors 20 even when the paper feeding cassette 1 is roughly moved in the paper-width direction. And with the simple structure comprising the lock pins 40, the through-holes 23 of the width-wise cursors 20, and the engagement holes 14 of the cassette frame 10, it is possible to surely fix the width-wise cursors 20 for various paper widths.

According to the first embodiment, the through-hole 23 is provided with the conic hole 23*b*, the lock pin 40 is provided with the engagement portion 40*a*, the conic portion 40*b* formed on the engagement portion 40*a*, and the cutout portions 40*c* formed on the conic portion 40*b*, the engagement portion 40*a* engages with the engagement hole 14, the conic portion 40*b* fits into the conic hole 23*b*, and thereby the width-wise cursors 20 are surely positioned and fixed to the cassette frame 10. Besides, because the gaps are formed between the conic hole 23*b* and the cutout portions 40*c*, to move the width-wise cursors 20, a user inserts a finger into the gap and pulls the lock pins 40 from the conic holes 23*b*, and the lock pins 40 are pulled out, accordingly the paper size can be easily changed.

Second Embodiment

Figure 5:
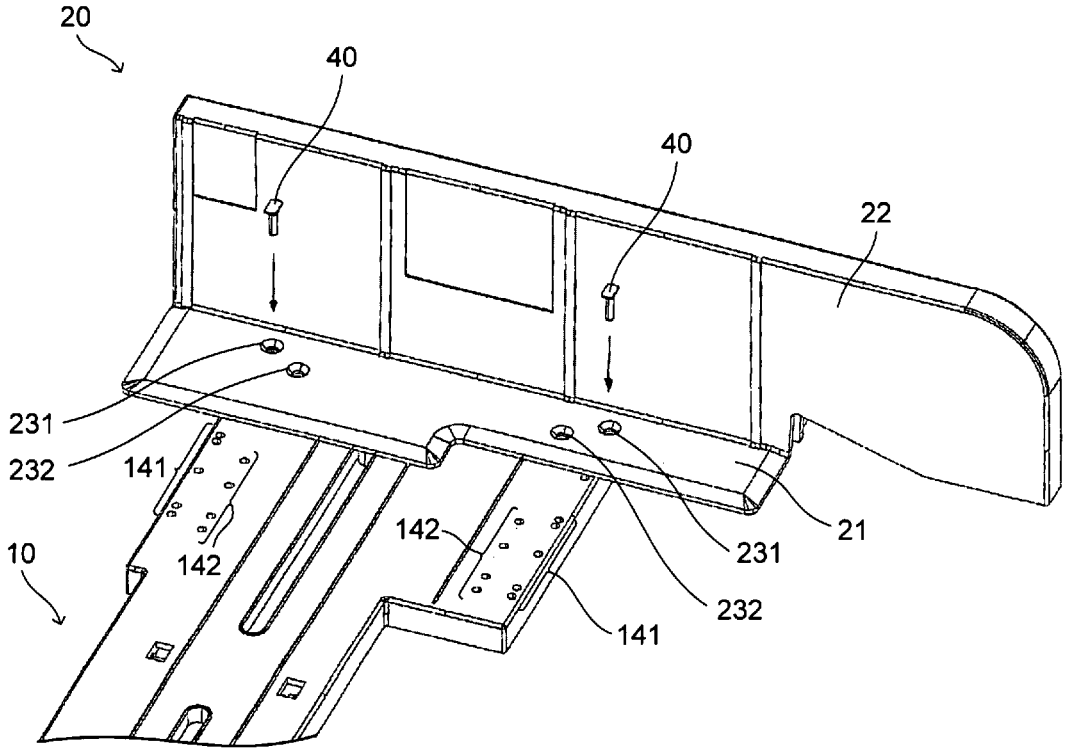
FIG. 5 is a perspective view showing a mounting portion of a width-wise cursor of a paper feeding cassette according to a second embodiment of the present invention.

FIG. 5 is a perspective view showing a mounting portion of a width-wise cursor of a paper feeding cassette according to a second embodiment of the present invention. A paper feeding cassette according to the second embodiment can selectively store paper of the metric- and inch-system paper sizes. Structures different from those in the first embodiment are explained and the explanation of the same parts is skipped.

The horizontal portion 21 of the width-wise cursor 20 is provided with a pair of through-holes 231 in the paper-length direction and another pair of through-holes 232 in the paper-length direction. The pair of through-holes 231 and the other pair of through-holes 232 are arranged in lines different from each other in the paper-width direction. The distance between the paired through-holes 231 is longer than that between the other paired through-holes 232. The pair of through-holes 231 are used to position and limit paper of the metric-system paper size, and the other pair of through-holes 232 are used to position and limit paper of the inch-system paper size. Notations to distinguish between the metric system and the inch system may be presented near each of the through-holes 231 and 232 of the width-wise cursor 20, or may be described in the instruction manual of the paper feeding cassette. Each of the through-holes 231, 232 has a conic hole into which the conic portion of the lock pin 40 fits.

The cassette frame 10 is provided with a line of a plurality of engagement holes 141 used for paper of the metric-system paper size corresponding to the pair of through-holes 231, and another line of a plurality of engagement holes 142 used for paper of the inch-system paper size corresponding to the pair of through-holes 232.

To position and limit paper of the metric-system paper size, the lock pins 40 are inserted into the through-holes 231 and engaged with the engagement holes for a desired paper size of the engagement holes 141, and thereby the width-wise cursors 20 are locked not to deviate in the paper-width direction. To position and limit paper of the inch-system paper size, the lock pins 40 are inserted into the through-holes 232 and engaged with the engagement holes for a desired paper size of the engagement holes 142, and thereby the width-wise cursors 20 are locked not to deviate in the paper-width direction.

According to this structure, paper of the metric- and inch-system paper sizes can selectively stored in the paper feeding cassette, and it is easy to recognize the position of a desired paper size system. Even if the kinds of paper size increase in a paper size system, it is possible to prevent the overlap between the plurality of engagement holes. Besides, it is possible for one paper feeding cassette to be compatible with many other kinds of paper size system besides the metric- and inch-system paper sizes without increasing the kinds of paper feeding cassette.

Third Embodiment

Figure 6:
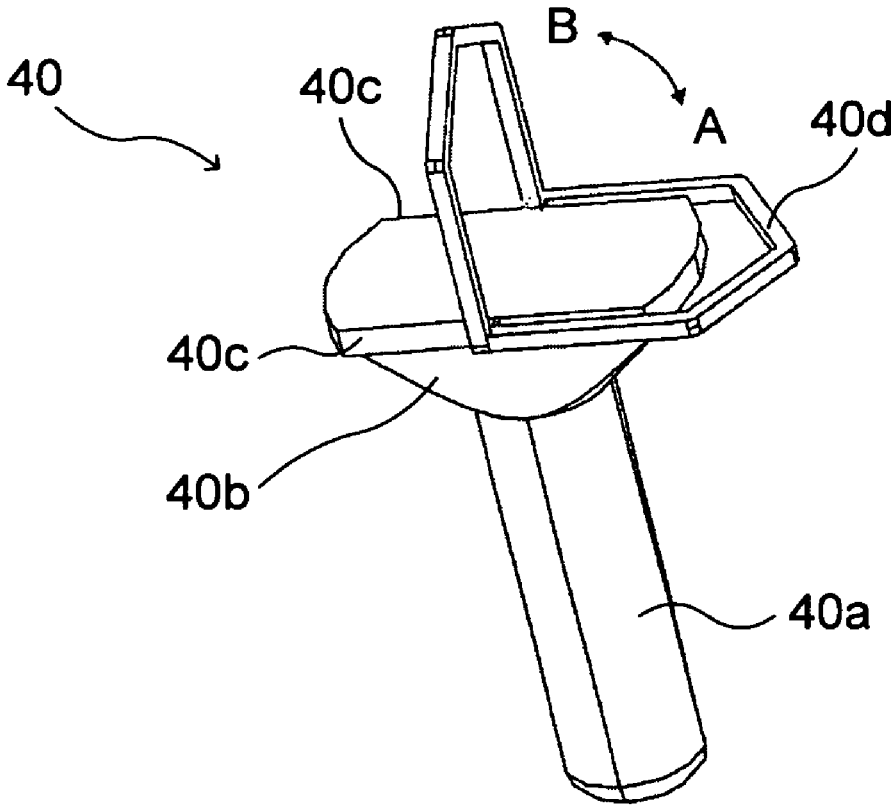
FIG. 6 is a perspective view showing a lock pin of a paper feeding cassette according to a third embodiment of the present invention.

FIG. 6 is a perspective view showing a lock pin of a paper feeding cassette according to a third embodiment of the present invention. The third embodiment shows a modification of the lock pin in the first and second embodiments.

The lock pin 40 is provided with the cylindrical engagement portion 40*a* and the conic portion 40*b* which has the cutout portion 40*c* on its upper portion. The two cutout portions 40*c* are provided with hooks 40*d* which are movable in the arrow direction as shown in FIG. 6. The hook 40*d* is composed of a plastic formed into a substantially U shape along both cutout portions 40*c*, and is used to insert and pull out the lock pin 40 into and from the through-hole 23. If the hook 40*d* is laid down in the direction along the lock pin 40 (the A position shown in FIG. 6) when the width-wise cursors 20 are positioned and fixed to the cassette frame 10, the hook 40 is stored in the through-hole 23, and when the hook 40*d* is raised upright in the axis direction of the lock pin 40 from the state (the B position shown in FIG. 6), a user can grip the hook 40*d* with a finger and pull out the lock pin 40 from the through-hole 23.

According to this structure, because the hook 40*d* is movably disposed on the conic portion 40*b* of the lock pin 40, it is easy to pull out the lock pin 40 from the through-hole 23.

Fourth Embodiment

Figure 7:
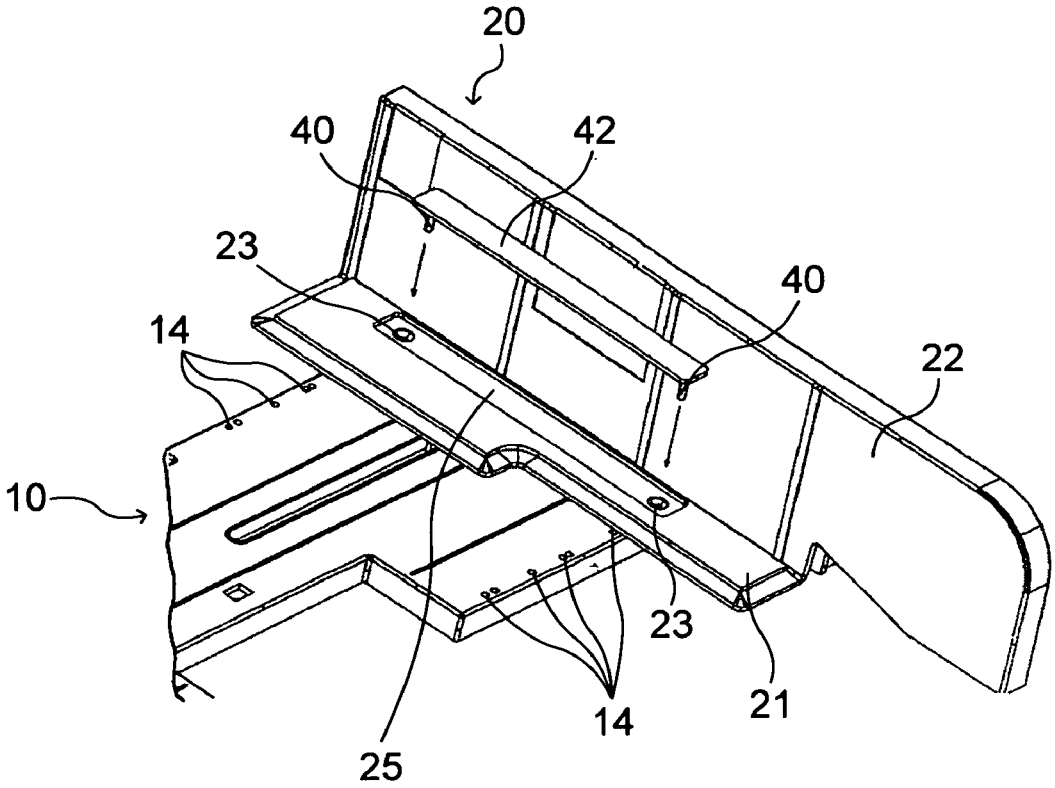
FIG. 7 is a perspective view showing a mounting portion of a width-wise cursor of a paper feeding cassette according to a fourth embodiment of the present invention.

FIG. 7 is a perspective view showing a mounting portion of a width-wise cursor of a paper feeding cassette according to a fourth embodiment of the present invention.

As shown in FIG. 7, the horizontal portion 21 of the width-wise cursor 20 is provided with a rectangular recessed portion 25 which is recessed from the upper portion of the horizontal portion 21 and extends in the paper-length direction. The recessed portion 25 is provided with a pair of through-holes 23 each having a conic hole. The pair of through-holes 23 are arranged corresponding to the distance of the paired engagement holes 14.

The lock pins 40 have a conic portion and an engagement portion, and fixed to the rectangular plate member 42 with a given distance so that it can fit into the pair of through-holes 23 and engage with the pair of engagement holes 14. When the pair of lock pins 40 fit into the pair of through-holes 23 and engage with the pair of engagement holes 14, the plate member 42 is stored in the recessed portion 25 and does not protrude outside the horizontal portion 21, while the width-wise cursors 20 are locked not to deviate in the paper-width direction.

When pulling out the lock pins 40 from the through-holes 23 and the engagement holes 14 to move the width-wise cursors 20, a user lifts the plate member 42, and thereby the pair of lock pins 40 are pulled out from the pair of through-holes 23 and the engagement holes 14.

According to the fourth embodiment, a plurality of pairs of engagement holes 14 in the paper-width-direction, a pair of through-holes 23, and the plate member 42 fixing and supporting a pair of lock pins 40 are provided, and the pair of lock pins 40 engage with the pair of engagement holes 41 via the pair of through-holes 23. Accordingly, because the width-wise cursors 20 are locked not to deviate in the paper-width direction when the lock pins 40 are inserted into the through-holes 23 and engaged with the engagement holes 14, it is possible to prevent the width-wise cursors 20 from deviating even if the paper feeding cassette 1 is moved roughly in the paper-width direction, besides with the simple structure comprising the lock pins 40, the through-holes 23 of the width-wise cursors 20, and the engagement holes 14 of the cassette frame 10, the width-wise cursors 20 can be surely fixed for various paper sizes. In addition, because the pair of lock pins 40 are fixed to and supported by the plate member 42, the lock pins 40 can be easily inserted and pulled out.

Fifth Embodiment

Figure 8:
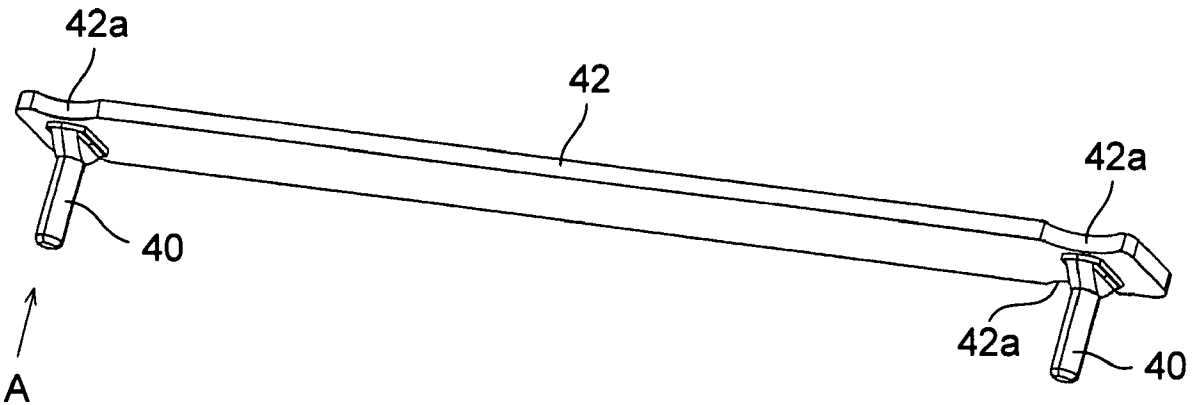
FIG. 8 is a perspective view showing a plate member of a paper feeding cassette according to a fifth embodiment of the present invention.
Figure 9:
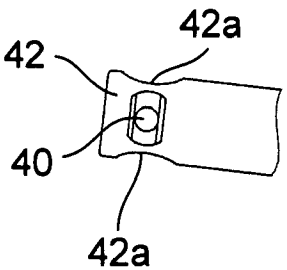
FIG. 9 is a plan view showing the plate member of the paper feeding cassette of the fifth embodiment of the present invention.

FIG. 8 is a perspective view showing a plate member of a paper feeding cassette according to a fifth embodiment of the present invention, and FIG. 9 is a plan view showing the plate member seen from the arrow A direction in FIG. 8. The fifth embodiment shows a modification of the plate member in the fourth embodiment.

As shown in FIGS. 8 and 9, four cutouts 42*a* are formed at edge portions near the places where the lock pins 40 are fixed to the plate member 42. When a pair of lock pins 40 fit into a pair of through-holes 23 of the width-wise cursor 20 and engage with a pair of engagement holes 14, and thus the plate member 42 is stored in the recessed portion 25, a gap is formed by the cutout 42*a* between the edge of the plate member 42 and the recessed portion 25. A user can grip the plate member 42 with a finger and pull out it from the recessed portion 25. Instead of providing the plate member 42 with the cutouts 42*a*, a gap may be made between the edge of the plate member 42 and the recessed portion 25 by enlarging the width of the recessed portion 25 near the through-hole 23. In this case, the cutout portion 40*c* may not be formed on the conic portion of the lock pin 40.

According to this structure, a gap is formed between the edge of the plate member 42 and the recessed portion 25 of the width-wise cursor 20, and when a user inserts a finger into the gaps and pulls the plate member 42 from the recessed portion 25, the lock pins 40 are pulled out from the engagement holes 14, and thereby the paper size can be easily changed.

Sixth Embodiment

Figure 10:
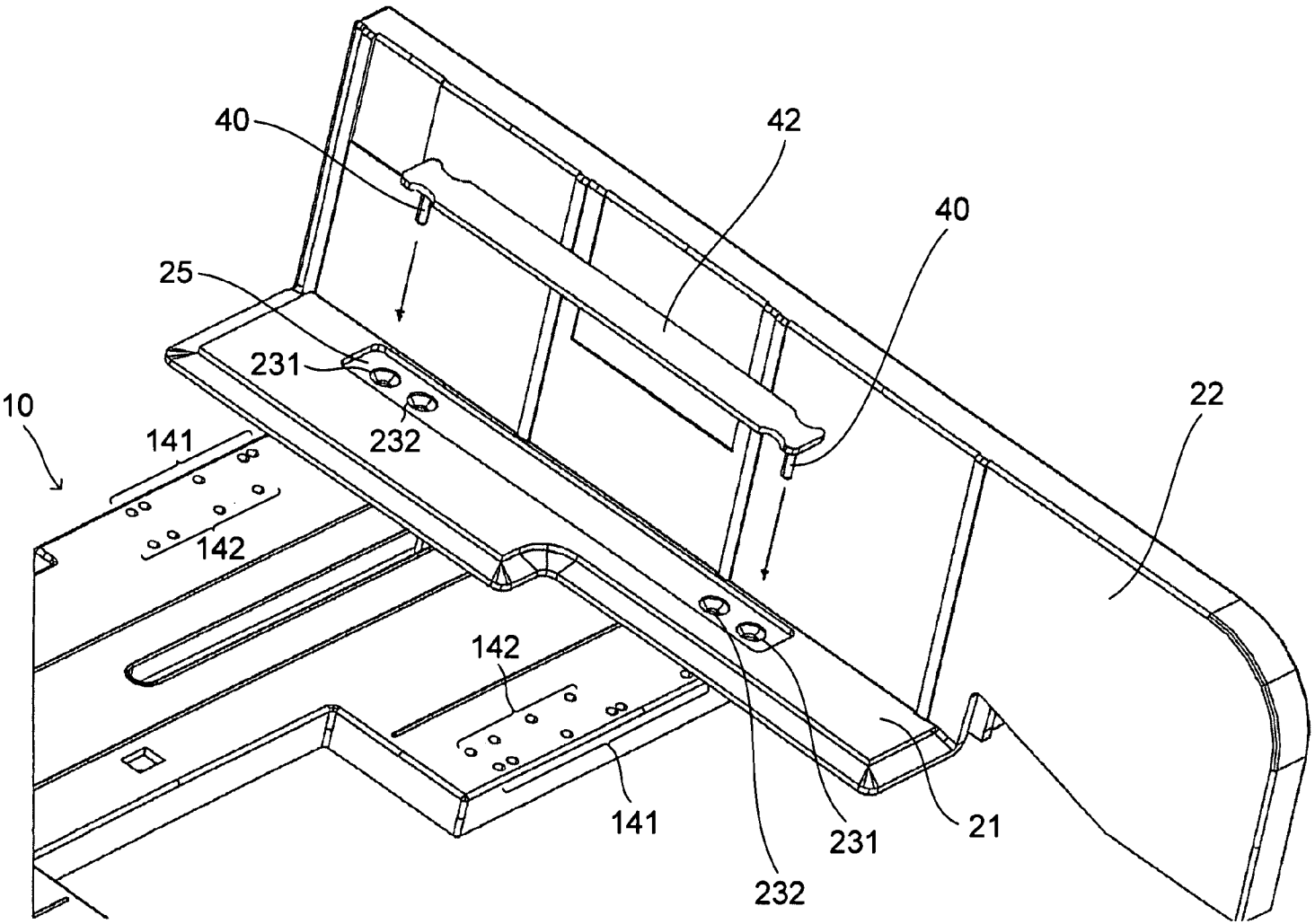
FIG. 10 is a perspective view showing a mounting portion of a plate member of a paper feeding cassette according to sixth embodiment of the present invention.

FIG. 10 is a perspective view showing a mounting portion of a width-wise cursor of a paper feeding cassette according to a sixth embodiment of the present invention. The sixth embodiment shows a modification of the paper feeding cassette according to the second embodiment that can selectively store paper of the metric- and inch-system paper sizes.

The horizontal portion 21 of the width-wise cursor 20 is provided with the recessed portion 25 recessed from the upper portion of the horizontal portion 21 to accommodate the plate member 42. Through the recessed portion 25, a pair of through holes 231 are formed in the paper-length direction, and another pair of through-holes 232 are formed in the paper-length direction. The pairs of through-holes 231 and 232 are aligned in the paper-width direction. The distance between the paired through-holes 231 is longer than that between the paired through-holes 232. The pair of through-holes 231 are used to position and limit paper of the metric-system paper size, and the other pair of through-holes 232 are used to position and limit paper of the inch-system paper size.

Each of the through-holes 231 and 232 has a conic hole into which the conic portion of the lock pin 40 fits.

The cassette frame 10 is provided with a line of a plurality of engagement holes 141 used for the metric-system paper sizes corresponding to the pair of through-holes 231, and another line of a plurality of engagement holes 142 used for the inch-system paper sizes corresponding to the other pair of through-holes 232.

Two plate members 42 are prepared to be compatible with paper of the metric- and inch-system paper sizes. The plate member 42 for the metric-system paper size is so formed that the paired lock pins 40 have the distance equal to that between the paired through-holes 231. On the other hand, the plate member 42 for the inch-system paper size is so formed that the paired lock pins 40 have the distance equal to that between the paired through-holes 232. Near the lock pins 40, four cutouts may be formed at the edges of the plate member 42. In this case, the cutout portions 40*c* may not be formed on the conic portion of the lock pins 40.

To store paper of the metric-system paper size in the paper feeding cassette, the lock pins 40 of the plate member 42 for the metric-system paper size are engaged with the engagement holes for a desired paper size of the engagement holes 141 via the pair of through-holes 231. On the other hand, to store paper of the inch-system paper size in the paper feeding cassette, the lock pins 40 of the plate member 42 for the inch-system paper size are engaged with the engagement holes for a desired paper size of the engagement holes 142 via the other pair of through-holes 232.

According to this structure, paper of the metric- and inch-system paper sizes can be selectively stored, and it is easy to recognize the position of a desired paper size system. Even if the kinds of paper size increase in a paper size system, it is possible to prevent the overlap between the plurality of engagement holes. Further, it is possible for one paper feeding cassette to be compatible with many kinds of paper size systems besides the metric- and inch-systems without increasing the kinds of paper feeding cassettes. Besides, because the lock pins 40 are fixed to and supported by the plate member 42, the lock pins 40 can be easily inserted and pulled out.

Seventh Embodiment

Figure 11:
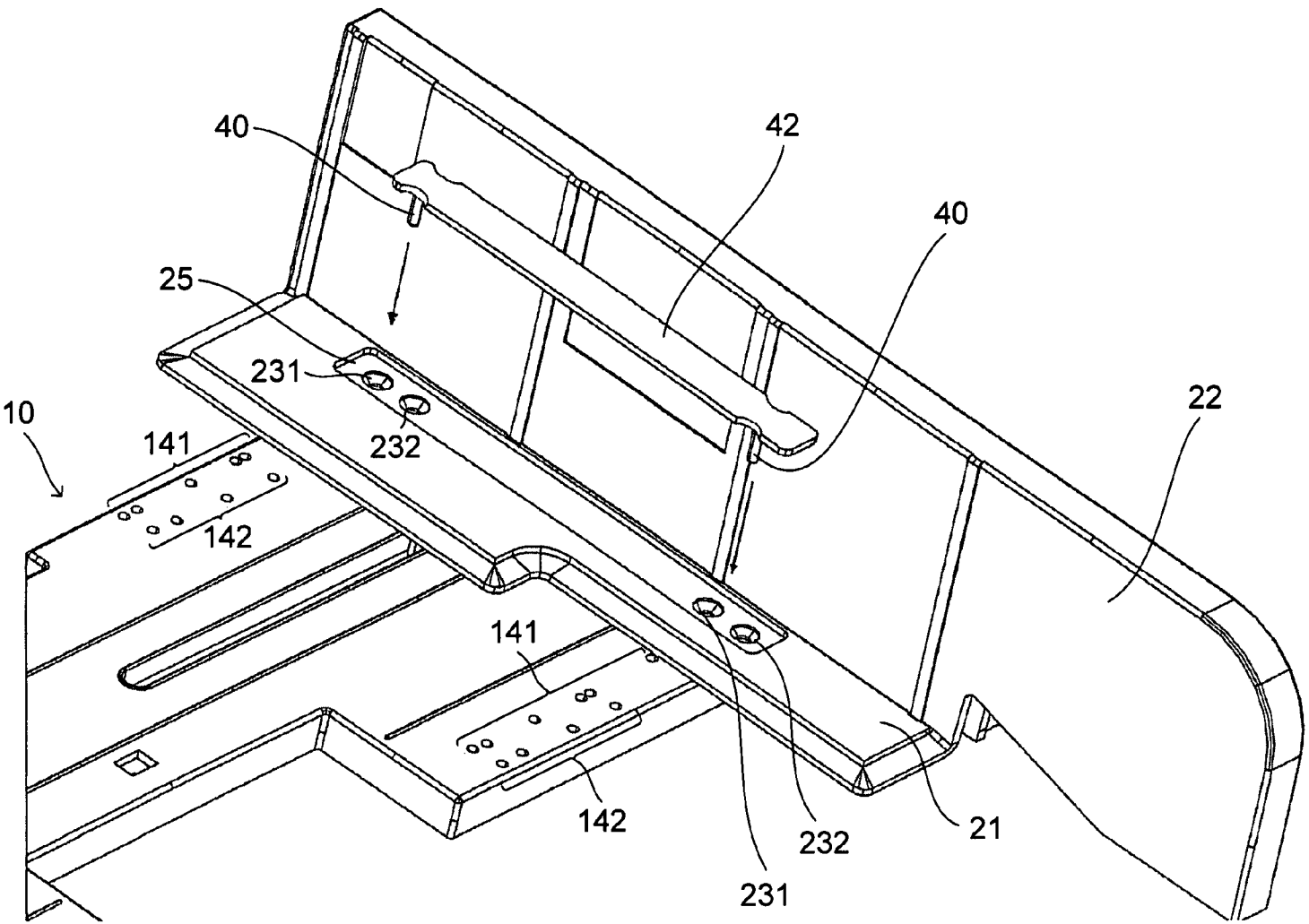
FIG. 11 is a perspective view showing a mounting portion of a plate member of a paper feeding cassette according to seventh embodiment of the present invention.

FIG. 11 is a perspective view showing a mounting portion of a width-wise cursor of a paper feeding cassette according to a seventh embodiment of the present invention. The seventh embodiment shows another modification of the width-wise cursor in the second embodiment which can selectively store paper of the metric- and inch-system paper sizes.

The horizontal portion 21 of the width-wise cursor 20 is provided with the recessed portion 25 recessed from the upper portion of the horizontal portion 21 to accommodate the plate member 42. Through the recessed portion 25, a pair of through holes 231 are formed in the paper-length direction, and another pair of through-holes 232 are formed in the paper-length direction. The pairs of through-holes 231 and 232 are aligned in the paper-width direction. The distance between the paired through-holes 231 is equal to that between the paired through-holes 232. The pair of through-holes 231 are used to position and limit paper of the metric-system paper size, and the other pair of through-holes 232 are used to position and limit paper of the inch-system paper size. Each of the through-holes 231 and 232 has a conic hole into which the conic portion of the lock pin 40 fits.

The cassette frame 10 is provided with a line of a plurality of engagement holes 141 used for the metric-system paper sizes corresponding to the pair of through-holes 231, and another line of a plurality of engagement holes 142 used for the inch-system paper sizes corresponding to the other pair of through-holes 232.

The plate member 42 is provided with the pair of lock pins 40. The paired lock pins 40 are formed to have the distance equal to that between the paired through-holes 231 (the other paired through-hole 232). Near the lock pins 40, four cutouts may be formed at edges of the plate member 42. In this case, the cutout portions 40*c* may not be formed on the conic portion of the lock pins 40.

To store paper of the metric-system paper size in the paper feeding cassette, the lock pins 40 of the plate member 42 are engaged with the engagement holes for a desired paper size of the line of engagement holes 141 via the pair of through-holes 231. On the other hand, to store paper of the inch-system paper size in the paper feeding cassette, the lock pins 40 of the plate member 42 are engaged with the engagement holes for a desired paper size of the line of engagement holes 142 via the other pair of through-holes 232.

According to this structure, paper of the metric- and inch-system paper sizes can be selectively stored, and it is easy to recognize the position of a desired paper size system. Even if the kinds of paper size increase in a paper size system, it is possible to prevent the overlap between the plurality of engagement holes. Further, it is possible for one paper feeding cassette to be compatible with many kinds of paper size systems besides the metric- and inch-systems without increasing the kinds of paper feeding cassettes. Besides, because the lock pins 40 are fixed to and supported by the plate member 42, the lock pins 40 can be easily inserted and pulled out. Further, it is possible for one plate member 42 to be compatible with many kinds of paper size systems, which simplifies the structure of the apparatus.

Eighth Embodiment

Figure 12:
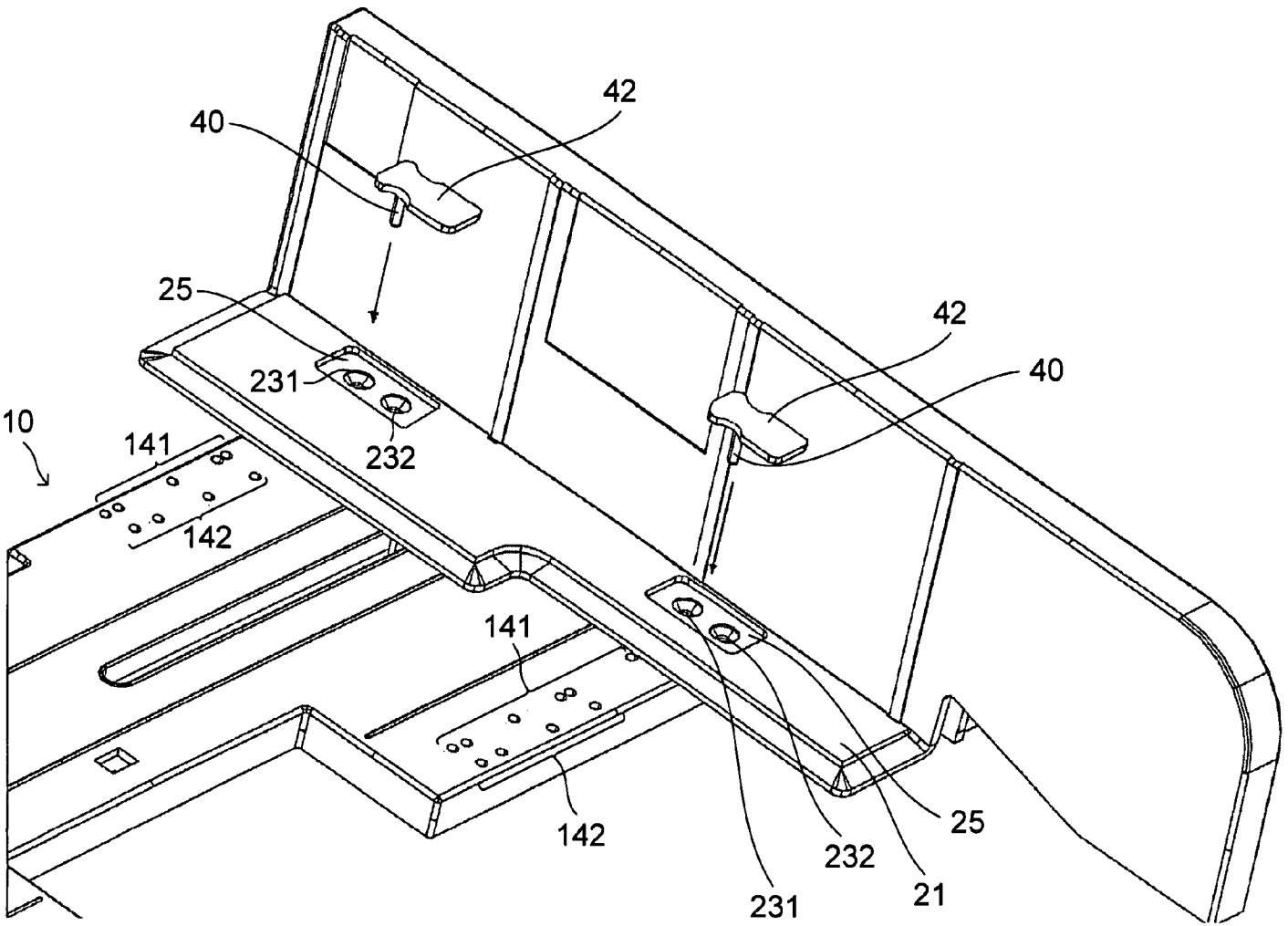
FIG. 12 is a perspective view showing a mounting portion of a plate member of a paper feeding cassette according to eighth embodiment of the present invention.

FIG. 12 is a perspective view showing a mounting portion of a width-wise cursor of a paper feeding cassette according to an eighth embodiment of the present invention. The eighth embodiment shows a still another modification of the width-wise cursor in the second embodiment.

The horizontal portion 21 of the width-wise cursor 20 is provided with two recessed portions 25 recessed from the upper portion of the horizontal portion 21 to accommodate two plate members 42. Through each recessed portion 25, two through holes 231 and 232 are arranged and formed in the paper-length direction. The one pair of through-holes 231 and the other pair of through-holes 232 are aligned in the paper-width direction. The distance between the paired through-holes 231 is equal to that between the paired through-holes 232. The pair of through-holes 231 are used to position and limit paper of the metric-system paper size, and the other pair of through-holes 232 are used to position and limit paper of the inch-system paper size. Each of the through-holes 231 and 232 has a conic hole into which the conic portion of the lock pin 40 fits.

The cassette frame 10 is provided with a line of a plurality of engagement holes 141 used for the metric-system paper sizes corresponding to the pair of through-holes 231, and another line of a plurality of engagement holes 142 used for the inch-system paper sizes corresponding to the other pair of through-holes 232.

The plate member 42 has substantially the same shape as the recessed portion 25 of the horizontal portion 21 and is formed into a somewhat small shape to be accommodated in the recessed portion 25. One lock pin 40 is fixed to the plate member 42 at a position deviated from the center in the paper-length direction. Two plate members 42 having the same shape are prepared for one width-wise cursor 20. Near the lock pins 40, two cutouts may be formed at edges of the plate member 42. In this case, the cutout portions 40*c* may not be formed on the conic portion of the lock pins 40.

To store paper of the metric-system paper size in the paper feeding cassette, as shown in FIG. 12, the lock pins 40 of the two plate members 42 are engaged with the engagement holes for a desired paper size of the line of engagement holes 141 via the pair of through-holes 231. On the other hand, to store paper of the inch-system paper size in the paper feeding cassette, the two plate members 42 are turned 180° in order for the lock pins 40 of the two plate members 42 to face the other pair of through-holes 232, and are engaged with the engagement holes for a desired paper size of the line of engagement holes 142 via the other pair of through-holes 232.

According to this structure, paper of the metric- and inch-system paper sizes can be selectively stored, and it is easy to recognize the position of a desired paper size system. Even if the kinds of paper size increase in a paper size system, it is possible to prevent the overlap between the plurality of engagement holes. Further, it is possible for one paper feeding cassette to be compatible with many kinds of paper size systems besides the metric- and inch-systems without increasing the kinds of paper feeding cassettes. Besides, because the lock pins 40 are fixed to and supported by the plate member 42, the lock pins 40 can be easily inserted and pulled out. Further, if the plate members 42 having the same shape are used in a set, it is possible to be compatible with many kinds of paper size systems, which simplifies the structure of the apparatus.

In the embodiment described above, explained is the structure where the lock pin 40 engages with the engagement hole 14 via the hole 23*a* and the conic hole 23*b* of the through-hole 23. However, the present invention is not limited to this structure, and if the hole 23*a* and conic hole 23*b* are designed to have the dimensions described in ISO 1478 and ISO 7721, a user can fix the width-wise cursor 20 more firmly using general fixing members instead of the lock pin 40 according to service conditions.

In the embodiments described above, the present invention is applied to the paper feeding cassettes which movably conduct the positioning of paper in the paper-width direction. However, the present invention is not limited to these embodiments, that is, in a paper feeding cassette which slides the cassette frame 10 in the paper-length direction, the same effects as those in the embodiments described above are obtained if the positioning of paper is movably carried out in the paper-length direction.

The present invention has a cursor which carries out the positioning of paper at an appropriate paper feeding position, and can be applied to general paper feeding cassettes which can be pulled out from a machine main body.

What is claimed is:

1. A paper feeding cassette, comprising:

a cassette frame for loading and storing paper;

a cursor which is disposed in the cassette frame and movably carries out the positioning of paper;

a through-hole formed through the cursor;

a plurality of engagement holes formed in the cassette frame corresponding to a paper size; and a lock pin for engaging with the engagement holes via the through-hole to fix the cursor not to deviate in the moving direction, wherein the through-hole is provided with a conic hole, the lock pin is provided with an engagement portion and a conic portion formed on the engagement portion, the conic portion of the lock pin is provided with two cutout portions that are formed to be linear and parallel with each other, two gaps opposite to each other are formed between the conic hole and the cutout portions when the engagement portion engages with the engagement hole and the conic portion fits into the conic hole, and the cassette is capable of being pulled out from a machine main body.

2. The paper feeding cassette according to claim 1, wherein the cassette frame is provided with a plurality of lines each having the plurality of engagement holes corresponding to a plurality of paper size systems, and the cursor is provided with through-holes corresponding to each of the lines of the engagement holes.

3. The paper feeding cassette according to claim 2, wherein the respective lines of the engagement holes are provided in the direction perpendicular to the moving direction of the cursor and at positions apart from each other in parallel.

4. The paper feeding cassette according to claim 3, wherein the lock pin is fixed to a plate member.

5. The paper feeding cassette according to claim 4, wherein the distances between paired engagement holes of the respective lines of the engagement holes are so arranged as to be different from each other depending on the respective lines of the engagement holes, and a pair of the lock pins are disposed on the plate member corresponding to each of the respective lines of the engagement holes and with a different distance therebetween.

6. The paper feeding cassette according to claim 4, wherein the distances between paired engagement holes of the respective lines of the engagement holes are so arranged as to be equal to each other for the respective lines of the engagement holes, and a pair of the lock pins are disposed on the plate member corresponding to each of the respective lines of the engagement holes and with the same distance therebetween.

7. The paper feeding cassette according to claim 1, wherein the lock pin is fixed to a plate member.

8. The paper feeding cassette according to claim 7, wherein the cursor includes a horizontal portion on which paper is loaded and a paper collision portion perpendicular to the horizontal portion, the horizontal portion is disposed on the cassette frame, and when the conic portion fits into the conic hole, the plate member is accommodated in a recessed portion formed in the horizontal portion and does not protrude outside the horizontal portion.

9. The paper feeding cassette according to claim 8, near the place where the lock pin of the plate member is fixed, a gap is formed between an edge of the plate member and the recessed portion when the engagement portion engages with the engagement hole.

10. The paper feeding cassette according to claim 1, wherein a substantially U-shaped hook is provided along the cutout portions, and the hook is movable in the direction along the cutout portion and in the axis direction of the lock pin.

11. The paper feeding cassette according to claim 1, wherein the cursor includes a horizontal portion on which paper is loaded and a paper collision portion perpendicular to the horizontal portion, the horizontal portion is disposed on the cassette frame, and the conic hole is provided in the horizontal portion and the conic portion does not protrude outside the horizontal portion once it fits into the conic hole.

* * * * *